US010221863B2

(12) United States Patent
Tsubokawa

(10) Patent No.: US 10,221,863 B2
(45) Date of Patent: Mar. 5, 2019

(54) VACUUM PUMP

(71) Applicant: Shimadzu Corporation, Kyoto (JP)

(72) Inventor: Tetsuya Tsubokawa, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 488 days.

(21) Appl. No.: 14/974,230

(22) Filed: Dec. 18, 2015

(65) Prior Publication Data

US 2016/0273552 A1 Sep. 22, 2016

(30) Foreign Application Priority Data

Mar. 18, 2015 (JP) ..... 2015-054843

(51) Int. Cl.

| | |
|---|---|
| ***F04D 29/58*** | (2006.01) |
| ***F04D 19/04*** | (2006.01) |
| ***F04D 29/52*** | (2006.01) |
| ***F04D 29/54*** | (2006.01) |

(52) U.S. Cl.

CPC ..... *F04D 29/584* (2013.01); *F04D 19/042* (2013.01); *F04D 29/522* (2013.01); *F04D 29/541* (2013.01); *F04D 29/5853* (2013.01); *F05D 2260/607* (2013.01)

(58) Field of Classification Search

CPC .... F04D 29/584; F04D 29/541; F04D 19/042; F04D 29/522; F04D 29/5853; F04D 19/04; F04D 19/044; F04D 19/046; F04D 19/048; F05D 2260/607

See application file for complete search history.

(56) References Cited

U.S. PATENT DOCUMENTS

| | | | | |
|---|---|---|---|---|
| 5,924,841 A * | 7/1999 | Okamura | F04D 19/046 | 415/176 |
| 6,409,468 B1 * | 6/2002 | Kawasaki | F04D 17/168 | 415/199.3 |
| 6,699,009 B2 * | 3/2004 | Fahrenbach | F04D 19/04 | 415/90 |
| 6,793,466 B2 * | 9/2004 | Miyamoto | F04D 19/04 | 415/177 |

(Continued)

FOREIGN PATENT DOCUMENTS

| | | |
|---|---|---|
| JP | 4-116693 U | 10/1992 |
| JP | 06-159287 | 6/1994 |

(Continued)

OTHER PUBLICATIONS

Office Action for corresponding Chinese Patent App. No. 201510994332.0, dated Jan. 3, 2018.

(Continued)

*Primary Examiner* — Eldon T Brockman

(74) *Attorney, Agent, or Firm* — Renner Otto Boisselle & Sklar, LLP

(57) ABSTRACT

A vacuum pump comprises: a stator; a rotor that rotates with respect to the stator; a pump casing in which the stator and the rotor are contained, and a suction port and a through-hole for exhaust are provided; a first exhaust duct fixed to an outer circumference of the pump casing so as to communicate with the through-hole for exhaust; and a second exhaust duct that is inserted into at least the through-hole for exhaust with a gap interposed, an exhaust gas passing inside the second exhaust duct.

18 Claims, 5 Drawing Sheets

(56) References Cited

U.S. PATENT DOCUMENTS

| | | | | |
|---|---|---|---|---|
| 2002/0114695 | A1* | 8/2002 | Fahrenbach | F04D 19/04 415/90 |
| 2015/0275914 | A1* | 10/2015 | Tsutsui | F04D 17/08 415/177 |
| 2016/0025096 | A1* | 1/2016 | Shi | F04D 19/042 417/423.1 |

FOREIGN PATENT DOCUMENTS

| | | | |
|---|---|---|---|
| JP | 2002021775 | A | 1/2002 |
| JP | 2003269369 | A | 9/2003 |

OTHER PUBLICATIONS

Notification of Reasons for Refusal for corresponding Japanese Patent App. No. 2015-054843, dated May 15, 2018.

* cited by examiner

VACUUM PUMP

BACKGROUND OF THE INVENTION

1. Field of the Invention

The present invention relates to a vacuum pump suitable for exhaust of a gas that easily causes product deposition.

2. Description of the Related Art

Conventionally, a vacuum pump such as a turbo-molecular pump and the like has been used for chamber exhaust of a semiconductor manufacturing device, a liquid crystal manufacturing device or the like. In recent years, troubles have increased that in an etching process of a semiconductor manufacturing device and a liquid crystal manufacturing device, deposition of products on a vacuum pump is caused, so that a rotor of the vacuum pomp comes into contact with the products, and a problem or the like has arisen that an overhaul is required in a short period after the device starts operating.

These products are also deposited on an exhaust duct provided in a gas exhaust section of the vacuum pump. Since a pressure inside the exhaust duct is higher than that inside the vacuum pump, the product deposition in the exhaust duct is remarkable. When the product deposition inside the exhaust duct becomes remarkable, a duct line becomes gradually blocked, and a pump back pressure rises, which brings about a decrease in pump performance. Moreover, an increase in load accompanying the rise in pump back pressure increases pump heat generation, which brings about a rise in rotating body temperature. As a result, there arises a problem that a creep life of the rotor is lowered.

As a technique for reducing the above-described deposition of the products, a constitution described in Patent Literature 1 (Japanese Unexamined Patent Application Publication No. H6-159287) has been known. In a turbo-molecular pump described in Patent Literature 1, in a gas flow channel inside the pump, a partition wall made of a heat transfer body is provided, and the partition wall and a heating section located outside the pump are joined by a good conductor of heat, and the heating section is heated by an electric heater or the like.

However, in the case where heating is performed by the electric heater or the like, a heater, a temperature sensor, a controller for controlling the heater and the like, and the like are required separately.

SUMMARY OF THE INVENTION

A vacuum pump comprises: a stator; a rotor that rotates with respect to the stator; a pump casing in which the stator and the rotor are contained, and a suction port and a through-hole for exhaust are provided; a first exhaust duct fixed to an outer circumference of the pump casing so as to communicate with the through-hole for exhaust; and a second exhaust duct that is inserted into at least the through-hole for exhaust with a gap interposed, an exhaust gas passing inside the second exhaust duct.

Preferably the stator is fixed to the pump casing so as to be opposed to the rotor, and a screw groove is formed in a opposed surface of any one of the rotor and the stator, and the second exhaust duct is in thermal contact with the stator.

Preferably the stator is formed of aluminum-based metal, and the second exhaust duct is formed of aluminum-based metal.

Preferably the stator is formed of stainless steel, and the second exhaust duct is formed of aluminum-based metal.

Preferably the stator is fixed to the pump casing with a heat insulating member interposed.

Preferably a fixed wall formed at the one end of the second exhaust duct is fastened to an outer circumferential surface of the stator with bolt.

Preferably the second exhaust duct is contacted to a lower end of the stator.

Preferably in the temperature of the stator, the temperature of the lower end of the stator is the highest.

Preferably the vacuum pump further comprises a heater to heat the pump casing.

Preferably the second exhaust duct is inserted into only the through-hole for exhaust, and; the first exhaust duct is exchangeable.

Preferably the second exhaust duct is inserted into the through-hole for exhaust and the first exhaust duct with a gap interposed.

Preferably a gas outflow port of the second exhaust duct is disposed on an inner side in a radial direction with respect to a gas outflow port of the first exhaust duct.

Preferably the second exhaust duct extends from a gas outflow port of the through-hole for exhaust to a gas inflow port or to an inside of the pump casing.

Preferably the second exhaust duct is in thermal contact with the pump casing.

Preferably the second exhaust duct is fixed to an inner wall of the through-hole for exhaust.

Preferably the second exhaust duct is exchangeable.

According to the present invention, maintainability with respect to product deposition can be improved without adding a heater and the like that heat an exhaust duct.

DETAILED DESCRIPTION OF PREFERRED EMBODIMENTS

Hereinafter, preferred embodiments of the present invention will be described with reference to the drawings.

First Embodiment

Figure 1:
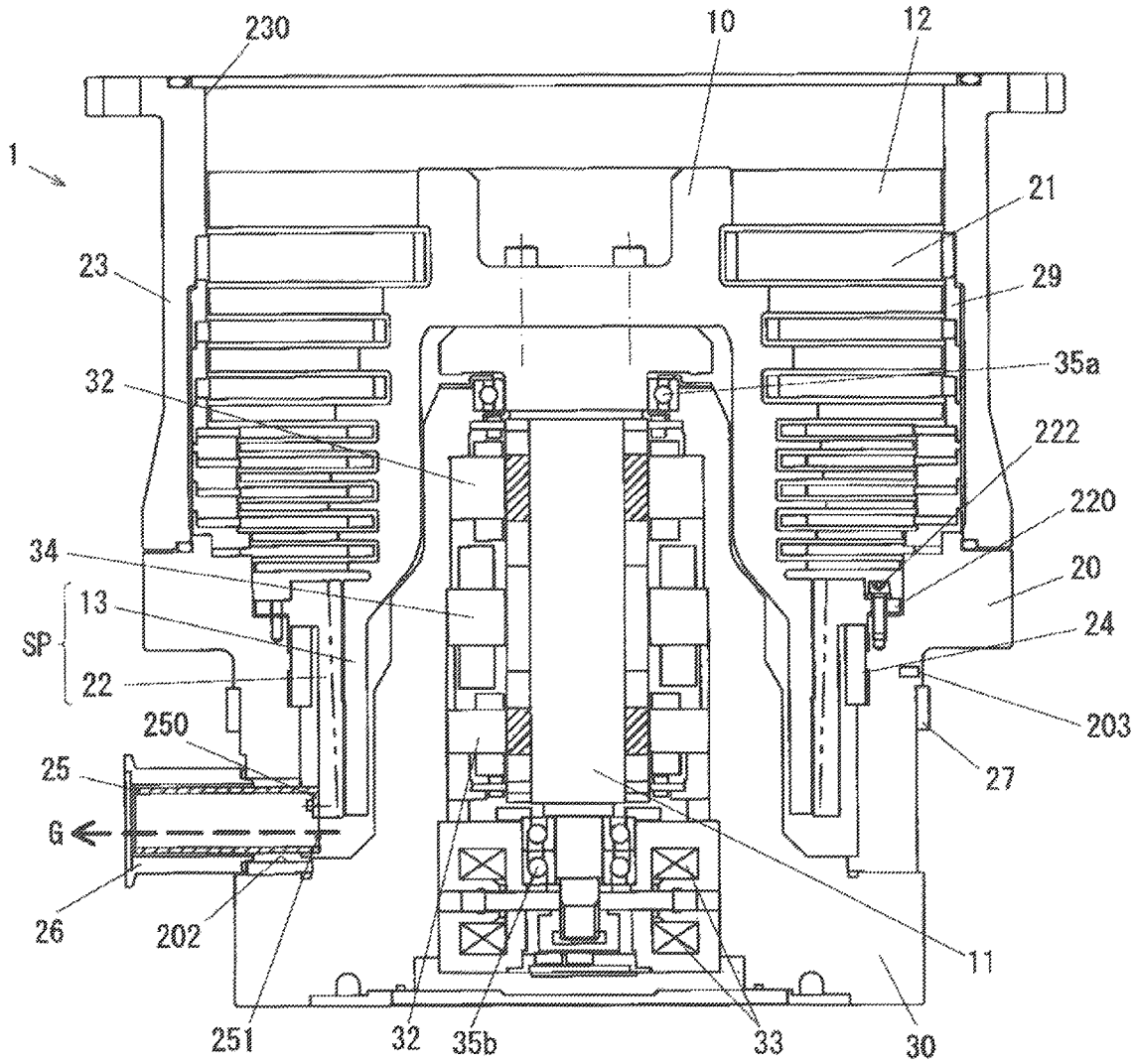
FIG. 1 is a view showing a first embodiment of a vacuum pump according to the present invention.

FIG. 1 is a view showing a first embodiment of a vacuum pump according to the present invention, and showing a cross section of a turbo-molecular pump. A turbo-molecular pump 1 includes a rotor 10 formed with a plurality of stages of rotor blades 12 and a rotor cylindrical section 13. A shaft 11 is fixed to the rotor 10, and the rotor shaft 11 is supported by radial magnetic bearings 32 and axial magnetic bearings 33 and is driven rotatively by a motor 34. When the magnetic bearings 32, 33 are not operated, the rotor shaft 11 is supported by mechanical bearings 35*a*, 35*b*. The radial magnetic bearings 32, the axial magnetic bearings 33, the motor 34, and the mechanical bearings 35*b* are contained in a base 30 fixed to a housing 20. While in the present embodiment, the housing 20 and the base 30 are separate bodies, the housing 20 and the base 30 may be constituted to be integrally formed.

Inside a pump case 23, a plurality of stages of stationary blades 21 are disposed so as to be layered, corresponding to the plurality of stages of rotor blades 12. The plurality of stages of stationary blades 21 layered in a pump axial direction, are disposed on the housing 20 with respective spacers 29 interposed. The rotor blades 12 and the stationary blades 21 are made of a plurality of turbine blades disposed in a circumferential direction.

On an outer circumferential side of the rotor cylindrical section 13, a cylindrical stator 22 is disposed with a gap interposed. The stator 22 is fixed to the housing 20 with bolts. In either of an outer circumferential surface of the rotor cylindrical section 13 or an inner circumferential surface of the stator 22, a screw groove is formed, and the rotor cylindrical section 13 and the stator 22 constitutes a screw groove pump section SP. In the example shown in FIG. 1, the screw groove is formed in the stator 22.

When the rotor 10 rotates at high speed, a gas flowing in from a suction port 230 of the pump case 23 is exhausted by the rotor blades 12 and the stationary blades 21, and is then further compressed by the screw groove pump section SP. Finally, as indicated by dashed arrow G, the gas is discharged from an exhaust duct 26 provided in a through-hole for exhaust 202 of the housing 20. A back pump or piping leading to the back pump is connected to the exhaust duct 26. In the housing 20, a heater 27 to heat the housing 20, and a temperature sensor 203 to detect a temperature of the housing 20 are provided.

Figure 2:
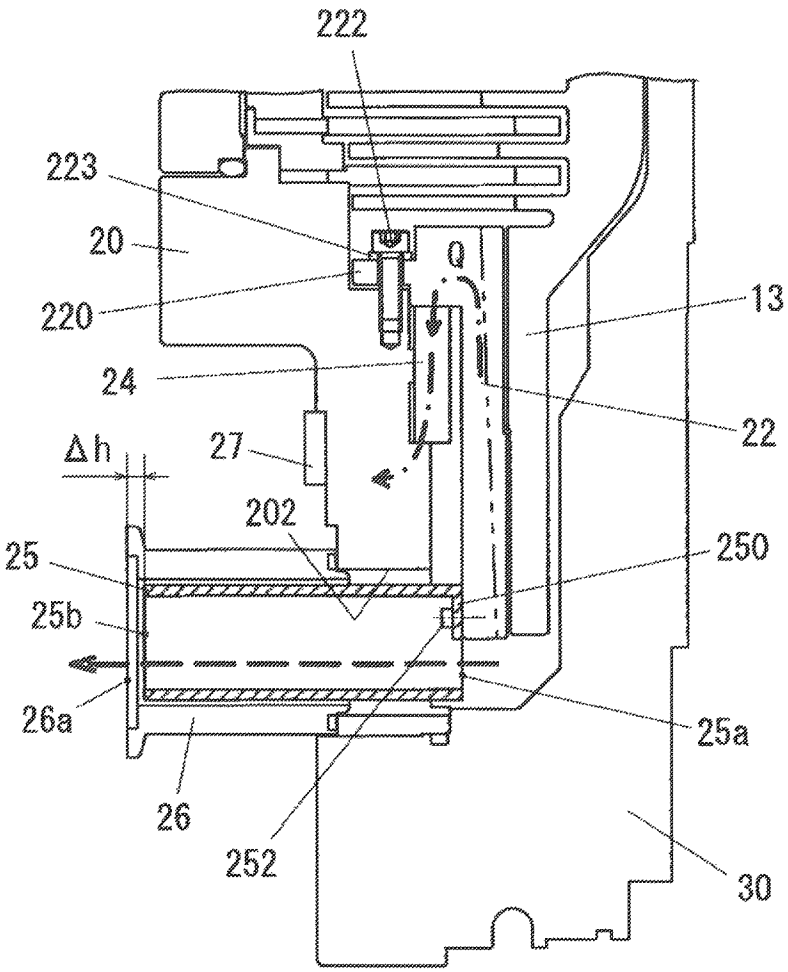
FIG. 2 is an enlarged view of a portion where an exhaust duct is provided.

FIG. 2 is an enlarged view of a portion where the exhaust duct 26 is provided. Inside the exhaust duct 26, a pipe 25 is disposed with a gap interposed. The pipe 25 is provided so as to penetrate the through-hole for exhaust 202 of the housing 20, and one end of the pipe 25 is fixed to the stator 22. A fixed wall 250 formed at the one end of the pipe 25 is fastened to an outer circumferential surface of the stator 22 with bolts 252. The gas compressed in the screw groove pump section SP enters the pipe 25 from a gas inflow port 25*a* formed under the fixed wall 250, and is discharged from a gas outflow port 25*b* (a left end portion in the figure) of the pipe 25.

Figure 3B:
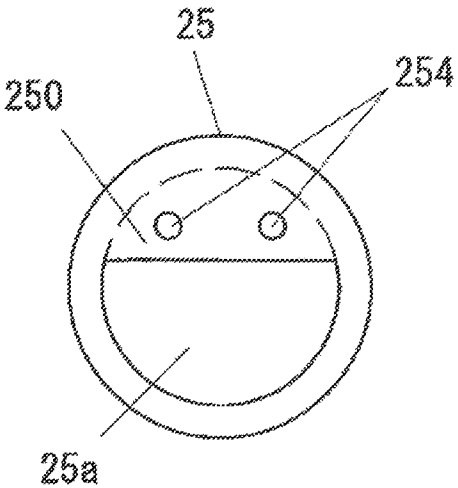
FIGS. 3A and 3B are views showing a shape of a pipe provided inside the exhaust duct.
Figure 3A:
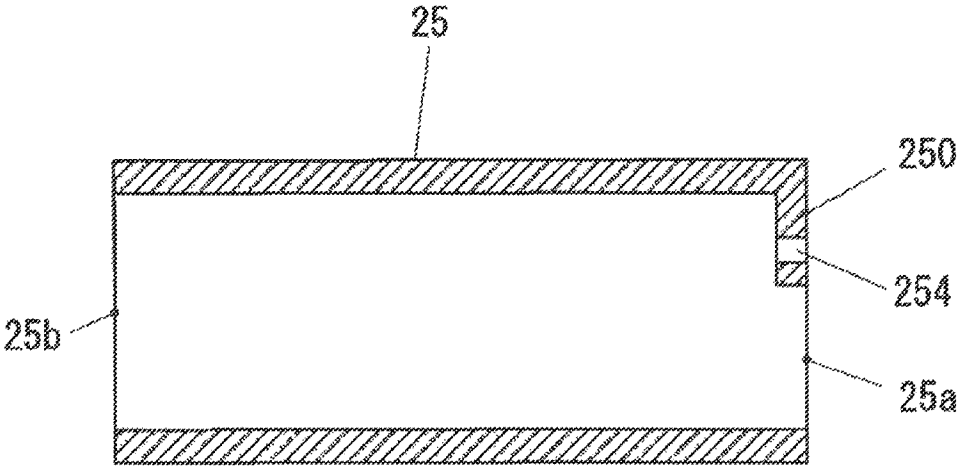

FIGS. 3A and 3B are views showing a shape of the pipe 25, FIG. 3A is a sectional view in an axial direction, and FIG. 3B is a view when the pipe 25 is seen from a direction of arrow A. In the fixed wall 250 provided at the right end in the figure of the pipe 25, through-holes 254 for fastening the bolts are formed. The portion under the fixed wall 250 is the gas inflow port 25*a*. This pipe 25 is to prevent products from being deposited on an inner wall of the exhaust duct 26 and an inner wall of the through-hole for exhaust 202 formed in the housing 20. The fixed wall 250 of the pipe 25 is fixed to the stator 22 with the bolts, which allows the stator 22 to heat the pipe 25 up to the same degree as a stator temperature.

As shown in FIG. 2, in the vacuum pump of the present embodiment, in order to reduce the deposition of the products on the stator 22, the heater 27 is provided in the housing 20. The stator 22 is placed on the housing 20 in a state where a heat insulating member 24 having a small heat conductivity is interposed, and is fixed with bolts 222. Metallic washers 223 formed of a heat insulating material are used to suppress the heat conduction to the housing 20 through the bolts 222.

The stator 22 is heated by radiant heat from the rotor cylindrical section 13 and frictional heat with the exhaust gas, so that the temperature of the stator 22→rises. Heat Q of the stator 22 mainly flows in a manner of the stator 22→the heat insulating member 24→the housing 20 as indicated by alternate long and short dashed line arrow. As a result, as to a temperature distribution of the stator 22, the temperature is highest at a lower end of the stator 22, and a portion closer to a flange section 220 fixed with the bolts has a lower temperature.

Transfer of the heat from the stator 22 to the housing 20 is more remarkable as a temperature difference between the housing 20 and the stator 22 is larger. Thus, the temperature of the housing 20 is increased by the heater 27 to thereby make the temperature difference between the housing 20 and the stator 22 small and suppress the transfer of the heat from the stator 22 to the housing 20. As a result, the temperature of the stator 22 is kept higher. The heat insulating member 24 having the small heat conductivity is interposed between the stator 22 and the housing 20, by which the heat transfer from the stator 22 to the housing 20 can be suppressed.

In the present embodiment, the pipe 25 is brought into thermal contact with the stator 22 (specifically with a lower end of the stator 22) to thereby keep a temperature of the pipe 25 high. This reduces the deposition of the products on the pipe 25 in which the gas flows. As a result, frequency of maintenance for product removal can be made lower without additionally providing a heater for heating the exhaust duct as in the related art. Moreover, the pipe 25 is provided so as to cover the inner walls of the exhaust duct 26 and the through-hole for exhaust 202. As a result, the deposition of the products on the inner walls of the exhaust duct 26 and the through-hole for exhaust 202 is almost prevented.

Even in a constitution where the stator 22 is directly fixed to the housing 20 without interposing the heat insulating member 24, the temperature of the stator 22 rises up to enough a degree to reduce the product deposition. Thus, the pipe 25 sufficiently functions as a member to reduce the product deposition.

While in the present embodiment, the stator 22 and the pipe 25 are formed of an aluminum alloy, the stator 22 may be formed of a material having a lower heat conductivity than that of the aluminum alloy (e.g., stainless steel). Forming the stator 22 of the material having the lower heat conductivity as described above makes a temperature gradient between a lower end and an upper end of the stator 22 larger than that of the aluminum alloy, which can keep a temperature at the lower end of the stator higher.

Since the one end of the pipe 25 is fixed to the stator 22, when the exit end (the gas outflow port 25*b*) of the pipe 25 interferes with another object, which allows an external force to act on the pipe 25, the gap between the stator 22 and the rotor cylindrical section 13 changes, thereby causing a problem. Consequently, in the present embodiment, in the constitution where the pipe 25 is disposed inside the exhaust duct 26, a radial distance $\Delta h$ between a gas outflow port 26*a* of the exhaust duct 26 and the gas outflow port 25*b* of the pipe 25 is preferably set to $\Delta h>0$ so that the pipe 25 is not projected from the gas outflow port 26*a* of the exhaust duct 26.

Second Embodiment

Figure 4:
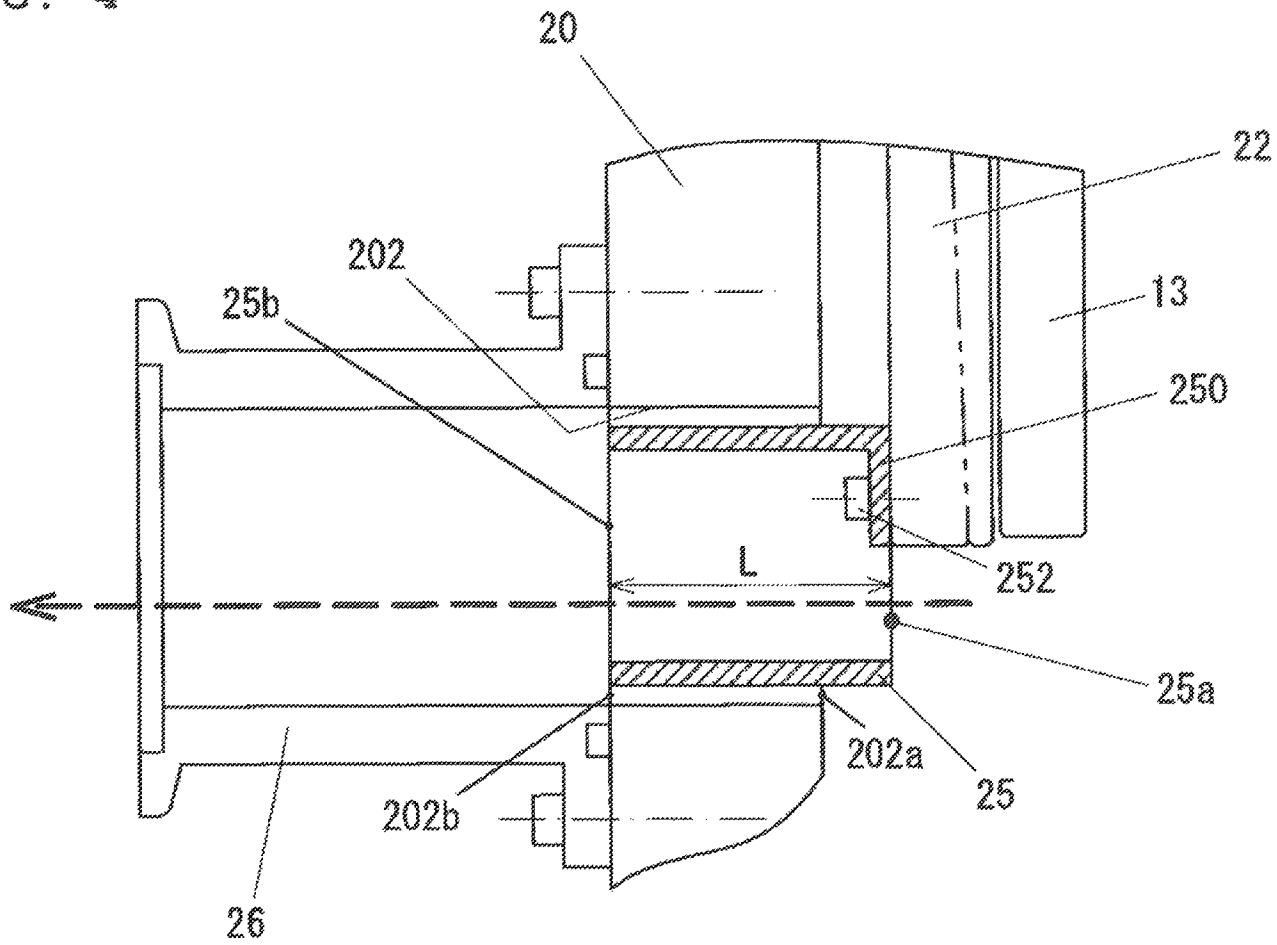
FIG. 4 is a view showing a second embodiment.

FIG. 4 is a view showing a second embodiment. In the second embodiment, a position of a gas outflow port 25*b* of a pipe 25 is almost equal to that of a gas outflow port 202*b* of a through-hole for exhaust 202. This constitution can prevent products from being deposited on an inner wall of the through-hole for exhaust 202. In this case, while the deposition of the products on an exhaust duct 26 cannot be avoided, the deposition on an inner wall of the through-hole for exhaust 202 is prevented, and thus, the frequency of the maintenance for product removal can be made lower. When the deposition of the products on the exhaust duct 26 exceeds a limit, the deposition can be addressed by exchanging the exhaust duct 26.

Third Embodiment

Figure 5:
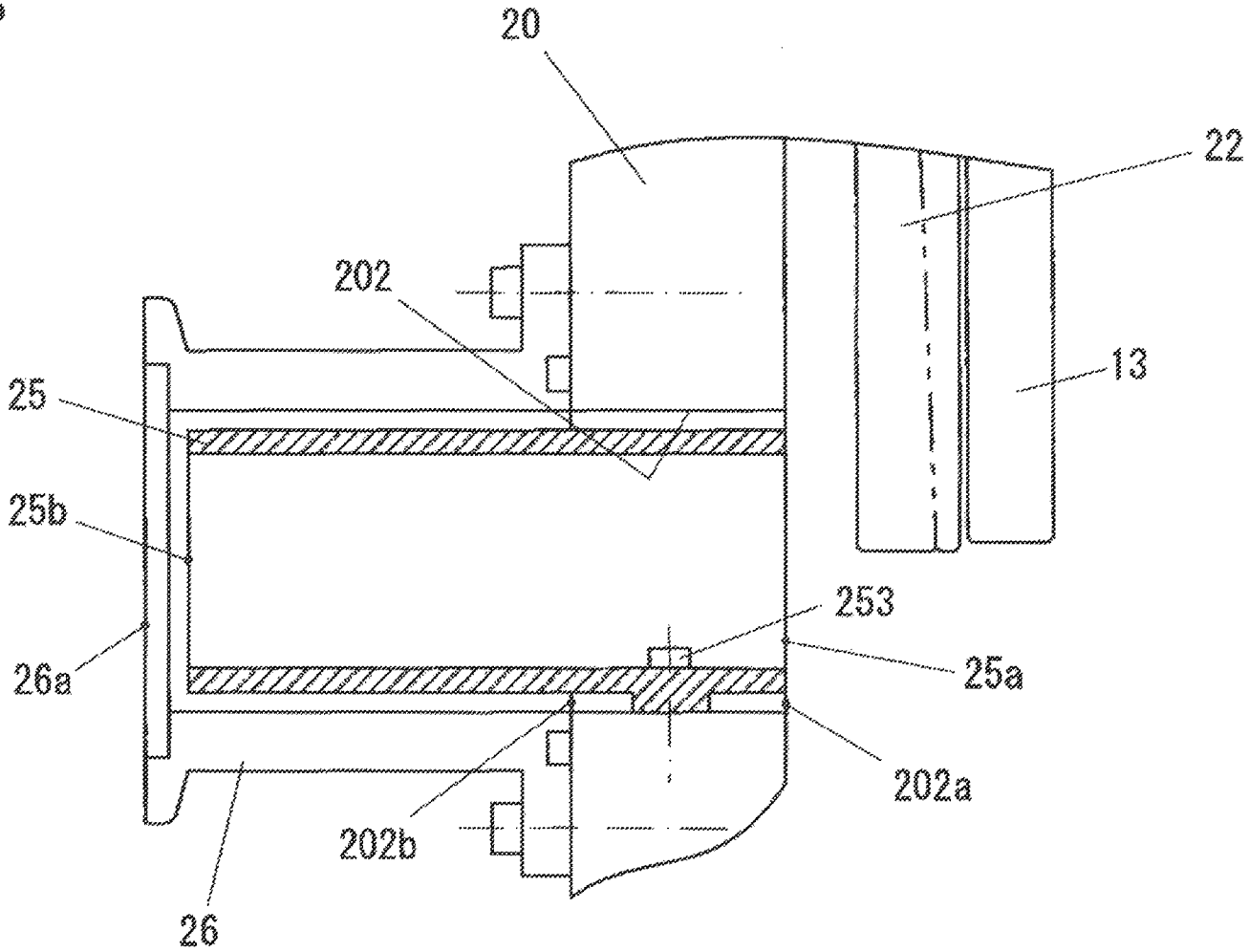
FIG. 5 is a view showing a third embodiment.

FIG. 5 is a view showing a third embodiment. In the third embodiment, a pipe 25 is fixed to a housing 20. In an example shown in FIG. 5, the pipe 25 is fixed to an inner wall of a through-hole for exhaust 202, using a bolt 253. The pipe 25 is formed of a metal such as an aluminum alloy, and has almost the same temperature as that of the housing 20.

In the case of the third embodiment, a gas passes an inside of the pipe 25 mainly kept at a base temperature. Thus, even if products are deposited on an inner wall of the pipe 25, products are hardly deposited on the through-hole for exhaust 202 and an exhaust duct 26. In this case, while the maintenance frequency of the deposition removal is considered to be almost the same as that in a case where the pipe 25 is not provided, in the case of the constitution in FIG. 5, exchanging only the pipe 25 on which the products are deposited suffices. This enables maintenance work to be simplified and shortened.

Similar to the constitution in FIG. 4, even when a length of the pipe 25 is set to a length up to a gas outflow port 202*b* of the through-hole for exhaust 202, the deposition of the products on the through-hole for exhaust 202 can be prevented, which enables the maintenance work to be simplified and shortened, as compared with the related art.

As described above, the turbo-molecular pump 1 includes the stator 22, the rotor cylindrical section 13 that rotates with respect to the stator 22, a pump casing (the pump case 23 and the housing 20) in which the stator 22 and the rotor cylindrical section 13 are contained, and the suction port 230 and the through-hole for exhaust 202 are provided, the exhaust duct 26 (a first exhaust duct) fixed to an outer circumference of the housing 20 so as to communicate with the through-hole for exhaust 202, and the pipe 25 (a second exhaust duct) that is inserted into at least the through-hole for exhaust 202 with the gap interposed, and the gas to be exhausted passes. Since the pipe 25 is fixed to the stator 22 or the housing 20 with the bolt (s) as shown in FIGS. 2 and 5, attachment and detachment with respect to the pump is easy.

In this constitution, in the case where the products are remarkably deposited on the inner wall of the pipe 25, exchanging only the pipe 25 suffices, which enables the maintenance work to be simplified and shortened. In order to prevent the products from being deposited on the through-hole for exhaust 202, for example, the pipe 25 may be extended from the gas outflow port 202*b* of the through-hole for exhaust 202 to an inner side with respect to the housing 20, as shown in FIG. 4. Moreover, as shown in FIG. 5, in the case where the pipe 25 is fixed to the housing 20, the pipe 25 may be extended from the gas outflow port 202*b* of the through-hole for exhaust 202 to the gas inflow port 202*a*. In this case, since the products are also deposited on the exhaust duct 26, the exhaust duct 26 may also be exchanged together with the pipe 25 in maintenance.

While in the above-described embodiments, the turbo-molecular pump including the pump section (the rotor blades 12 and the stationary blades 21) with the turbine blades formed, and the screw groove pump section SP has been described as an example, the present invention can also be applied to a full-wing type turbo-molecular pump including only the pump section made of the rotor blades 12 and the stationary blades 21. Moreover, the present invention can also be applied to a vacuum pump including only the screw groove pump section.

Furthermore, as in the constitution shown in FIG. 2, the pipe 25 may be brought into thermal contact with stator 22, which is a high-temperature section. Since this suppresses the deposition of the products on the pipe 25, the frequency of the maintenance can be made lower than that in the related art. When the length of the pipe 25 is set to be a length up to the gas outflow port 202*b* of the through-hole for exhaust 202, as shown in FIG. 4, the deposition of the products on the exhaust duct 26 cannot be avoided, so that the exhaust duct 26 may be exchanged in maintenance.

Moreover, as shown in FIG. 2, in the constitution where the pipe 25 is brought into contact with the stator 22, the gas outflow port 25*b*, which is a forefront on an exit side of the pipe 25, is preferably disposed on an inner side with respect to the gas outflow port 26*a* of the exhaust duct 26. This can prevent the interference with the pipe 25, and a bad influence on the stator 22 by the interference can be prevented.

As long as the characteristics of the present invention are not impaired, the present invention is not limited to the above-described embodiments.

What is claimed is:

1. A vacuum pump comprising:

a stator;

a rotor that rotates with respect to the stator;

a pump casing in which the stator and the rotor are contained, and a suction port and a through-hole for exhaust formed in an outer wall of the pump casing are provided;

a first exhaust duct fixed to an outer circumference of the pump casing so as to communicate with the through-hole for exhaust; and a second exhaust duct, discrete from the first exhaust duct, that is inserted into at least the through-hole for exhaust with a gap interposed between the second exhaust duct and the through-hole for exhaust, an exhaust gas passing inside the second exhaust duct, wherein the stator is fixed to the pump casing so as to be opposed to the rotor, and a screw groove is formed in a opposed surface of any one of the rotor and the stator, the second exhaust duct is in thermal contact with the stator, and a fixed wall formed at an end of the second exhaust duct is fastened to an outer circumferential surface of the stator with a bolt.

2. The vacuum pump according to claim 1, wherein the stator is formed of aluminum-based metal, and the second exhaust duct is formed of aluminum-based metal.

3. The vacuum pump according to claim 1, wherein the stator is formed of stainless steel, and the second exhaust duct is formed of aluminum-based metal.

4. The vacuum pump according to claim 1, wherein the stator is fixed to the pump casing with a heat insulating member interposed.

5. The vacuum pump according to claim 1, wherein the second exhaust duct is contacted to a lower end of the stator.

6. The vacuum pump according to claim 5, wherein in the temperature of the stator, the temperature of the lower end of the stator is the highest.

7. The vacuum pump according to claim 1, further comprising a heater to heat the pump casing.

8. The vacuum pump according to claim 1, wherein the second exhaust duct is inserted into only the through-hole for exhaust, and;

the first exhaust duct is exchangeable.

9. The vacuum pump according to claim 1, wherein the second exhaust duct is inserted into the through-hole for exhaust and the first exhaust duct with a gap interposed between the first exhaust duct and the second exhaust duct.

10. The vacuum pump according to claim 9, wherein a gas outflow port of the second exhaust duct is disposed on an inner side in a radial direction with respect to a gas outflow port of the first exhaust duct.

11. The vacuum pump according to claim 1, wherein the second exhaust duct extends from a gas outflow port of the through-hole for exhaust to a gas inflow port or to an inside of the pump casing.

12. The vacuum pump according to claim 1, wherein the second exhaust duct is in thermal contact with the pump casing.

13. The vacuum pump according to claim 12, wherein the second exhaust duct is fixed to an inner wall of the through-hole for exhaust.

14. The vacuum pump according to claim 1, wherein the second exhaust duct is exchangeable.

15. A vacuum pump comprising:

a stator;

a rotor that rotates with respect to the stator;

a pump casing in which the stator and the rotor are contained, and a suction port and a through-hole for exhaust formed in an outer wall of the pump casing are provided;

a first exhaust duct fixed to an outer circumference of the pump casing so as to communicate with the through-hole for exhaust; and a second exhaust duct, discrete from the first exhaust duct, that is inserted into at least the through-hole for exhaust with a gap interposed between the second exhaust duct and the through-hole for exhaust, an exhaust gas passing inside the second exhaust duct, wherein the stator is fixed to the pump casing so as to be opposed to the rotor, and a screw groove is formed in a opposed surface of any one of the rotor and the stator, the second exhaust duct is in thermal contact with the stator, and the second exhaust duct is contacted to a lower end of the stator.

16. The vacuum pump according to claim 15, wherein a fixed wall formed at an end of the second exhaust duct is fastened to an outer circumferential surface of the stator with a bolt.

17. The vacuum pump according to claim 15, wherein in the temperature of the stator, the temperature of the lower end of the stator is the highest.

18. The vacuum pump according to claim 15, wherein the second exhaust duct is inserted into the through-hole for exhaust and the first exhaust duct with a gap interposed between the first exhaust duct and the second exhaust duct.

* * * * *